United States Patent [19]

Okutsu et al.

[11] Patent Number: 4,701,595

[45] Date of Patent: Oct. 20, 1987

[54] PORTABLE HAND-HELD ELECTRIC HAIR DRYER WITH A RETRACTABLE HAND GRIP

[75] Inventors: Hideo Okutsu; Koushirou Mikami, both of Hikone; Kazuyoshi Yonezawa, Suita; Kuniharu Ichikawa, Kuze, all of Japan

[73] Assignee: Matsushita Electric Works, Ltd., Japan

[21] Appl. No.: 791,074

[22] Filed: Oct. 24, 1985

[30] Foreign Application Priority Data

Nov. 22, 1984 [JP] Japan ..... 59-248515

[51] Int. Cl.[4] ..... H05B 1/02; A45D 20/12; F24H 3/04

[52] U.S. Cl. ..... 219/364; 34/97; 34/243 R; 200/157; 219/370; 219/379; 219/533

[58] Field of Search ..... 219/366, 369–370, 219/372, 373, 379, 380, 271, 533; 34/96–101, 243 R; 200/157

[56] References Cited

U.S. PATENT DOCUMENTS

| | | | |
|---|---|---|---|
| 3,397,463 | 8/1968 | Laing | 34/97 |
| 3,695,066 | 10/1972 | Doyel | 219/271 X |
| 3,953,710 | 4/1976 | Dyer | 219/370 |
| 4,490,602 | 12/1984 | Ishihara | 219/366 |
| 4,556,782 | 12/1985 | Fujishima et al. | 219/370 |

FOREIGN PATENT DOCUMENTS

| | | |
|---|---|---|
| 149705 | 9/1983 | Japan . |
| 2131686 | 6/1984 | United Kingdom . |

*Primary Examiner*—Anthony Bartis

*Attorney, Agent, or Firm*—Stevens, Davis, Miller & Mosher

[57] ABSTRACT

A portable hand-held hair dryer having a housing formed with an elongate front edge portion along the edgewise direction of which is extended an air outlet for discharge of heated air. A hand grip is slidably connected to the front edge portion of the housing for movement therealong in a straight path between a retracted position in which the hand grip overlies the front edge portion to block the air outlet and a projected position in which the hand grip extends outwardly of the housing to be ready for being grasped by the hand of the user after opening the air outlet. A recess is formed in the housing at a portion adjacent to the function of the hand grip in its projected position so as to receive a portion of the user's hand grasping the hand grip. This recess is advantageous for providing a comfortable support of the hair dryer with a minimum projected length of the hand grip. A voltage selection switch is positioned so as to be accessible only when the hand grip is in its retracted position.

8 Claims, 24 Drawing Figures

PORTABLE HAND-HELD ELECTRIC HAIR DRYER WITH A RETRACTABLE HAND GRIP

BACKGROUND OF THE INVENTION

1. Field of the Invention

The present invention is directed to a portable hair dryer, more particularly to a portable hand-held hair dryer with a retractable hand grip.

2. Description of the Prior Art

A number of portable hand-held dryers for traveler's use and home use have been placed on the market. One typical example is disclosed in Japanese unexamined patent application publication (KOKAI) No. 58-149705 in which, as shown in FIGS. 1 and 2 of the attached drawings of this specification, a hand grip 1 is detachably attached to a dryer housing 4 with blower means. The hand grip 1 is shaped into a U-shaped member which fits over an air outlet end 5 of the housing 4 with its legs 2 and 3 being inserted into complementary grooves 6 and 7 formed in the housing 4 when the dryer is not in use. When the dryer is in use, the user has to detach the hand grip 1 from the housing 4 and then reattach it thereto by inserting the upper leg 2 to the lower groove 7, as shown in FIG. 2, so as to extend the hand grip 1 outwardly of the housing 4 ready for being grasped by the hand of the user. With this detachable hand grip 1, the hair dryer suffers problems that it necessitates the inconvenient operation of detaching and reattaching the hand grip 1 to the housing 4 for handling between the packed position and the extended position. In addition the detachable hand grip 1 is likely to be easily lost.

Another prior hair dryer is disclosed in U.K. patent application No. GB 2,131,686 A in which a dryer housing 10 has a foldable hand grip 11, as schematically shown in FIGS. 3 and 4 of the attached drawings. The hand grip 11 is pivoted at its end 12 to a corner portion of the housing 10 for movement between a folded position in which it is nested on the outlet end of the housing 10 and an extended position in which it extends outwardly from the housing 10. In this prior hair dryer with the pivoted hand grip 11, the danger is always present of accidental pinching of the fingers of the user between the hand grip and the housing during actual use. In addition, the prior hair dryers including the above-described ones have no provision of forming in the periphery of the housing at a portion adjacent the hand grip and rearwardly thereof a recess which is adapted to receive a part of the user's hand grasping the hand grip. Such a recess is desirable for providing comfortable and well-balanced support or handling of the hair dryer during the course of hair drying or styling operation while maintaining a length of the hand grip at a minimum dimension.

SUMMARY OF THE INVENTION

In view of the above, the present invention has been devised and aimed to provide a portable hand-held hair dryer of unique and advantageous construction. The portable hand-held dryer of the present invention comprises a housing with an air outlet and a hand grip slidably connected thereto. The housing incorporates means for producing and discharging a flow of heated air through the air outlet and is formed with an elongate front edge portion along the edgewise direction of which said air outlet extends. The hand grip slides in and out on a straight path along the lengthwise direction of the front edge portion for movement between an operating position in which the hand grip projects outwardly from the housing and a retracted position in which the hand grip overlies the straight edge portion thus covering the air outlet. Stopper means are formed on the front edge portion to prevent the hand grip from sliding beyond the operating position, thus eliminating an accidental slipping of the hand grip out of the housing. Formed in the periphery of the housing at a portion adjacent the projected hand grip and rearwardly thereof is a recess which is shaped to receive a portion of the user's hand grasping the hand grip. This simple sliding movement allows the operator to bring the hand grip from its retracted position to the projected position and vise versa, while insuring against an accidental loss of the hand grip off the housing as well as preventing the finger of the user's hand grasping the hand grip from being accidentally pinched between the hand grip and the housing at the time of placing the hand grip into its retracted position.

Accordingly, it is a primary object of the present invention to provide a portable hand-held hair dryer which is convenient and safe to use, yet assuring a compact arrangement in which the hand grip is retracted to overlie the housing to reduce the bulk of the hair dryer.

The front edge portion is formed with detent means by which the hand grip is clicked into either of its projected or retracted positions.

It is therefore another object of the present invention to provide a portable hand-held hair dryer in which the hand grip is stably held at either of its projected or retracted positions for easy handling of the hair dryer.

In preferred embodiments, a switch handle which is coupled to an electric switch controlling the operation of the hair dryer is slidably mounted on the surface of the housing adjacent the front edge portion to be movable between the on- and off-positions in a direction generally perpendicular to the sliding direction of the hand grip. The switch handle has a front end which is movable into and out of the sliding path of the hand grip such that, when the hand grip is in its retracted position, it abuts against the hand grip to be blocked from moving into the on-position and that. When the hand grip is in the projected position, the switch handle's path for movement is uncovered, allowing the switch handle to move into the on-position. Consequently, the switch handle is allowed to move into the on-position only when the hand grip is in its projected position. This is advantageous in that the hair dryer can be set into operation only when the hand grip has been extracted for use.

It is therefore a further object of the present invention to provide a portable hand-held dryer which is safe enough to prevent any accidental operation when the air outlet is covered by the retracted hand grip.

Also incorporated in the hair dryer of the present invention is a voltage selector for selection between high and low voltage sources, for example, 120 V and 240 V, to which the hair dryer is adapted to be connected for being energized thereby. The voltage selector is located at one longitudinal end of the front edge portion of the housing from which end the hand grip projects and is arranged in such a way as to be accessible only when the hand grip is slid into the retracted position. Thus, the voltage selector is operatively connected by way of the hand grip to said switch handle to have such an operational relation therewith that the voltage selector can be manipulated only after the switch handle is moved into the off-position shutting off the hair dryer in response to the hand grip being retracted. Consequently, the voltage selector is prevented from being manipulated so long as the switch handle is in the on-position. This provides a safe guard against accidental switching operation of the voltage selector while the dryer is energized. Such switching operation, if done with the dryer being left energized, would certainly damage the electric components of the hair dryer.

It is therefore a still further object of the present invention to provide a portable hand-held hair dryer which eliminates accidental switching of the voltage selector while the hair dryer is energized.

The front end of the switch handle, in one of the embodiments, is formed to have an inclined leading edge which is engageable with the edge of the hand grip. The inclined leading edge will come into edge-to-edge engagement with the hand grip, as the hand grip moves back to its retracted position with the switch handle being left in the on-position, to thereby translate the vertical movement of the hand grip into the horizontal movement of the switch handle, causing the switch handle to move back to its off-position. Thus, the hair dryer can be automatically shut off simply by sliding the hand grip into its retracted position and without requiring the operator to manipulate the switch handle.

It is therefore a still further object of the present invention to provide a portable hand-held hair dryer which is capable of being automatically shut off in response to the hand grip being slid back to the retracted position.

The present invention discloses still other advantageous features including a particular construction of the hand grip of U-shaped cross section and an alternative arrangement of the electric switch operable to turn on and off the dryer automatically in response to the sliding movement of the hand grip.

These and other objects and advantages will be become more apparent from the following detailed description when taken in conjunction with the accompanying drawings.

DESCRIPTION OF THE PREFERRED EMBODIMENTS

Figure 1:
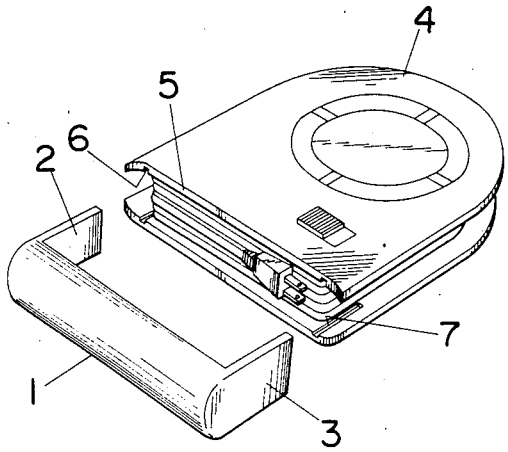
Fig. 1 (PRIOR ART)
FIGS. 1 and 2 are perspective views, in schematic representation, of a prior portable hair dryer with a hand grip detached and attached, respectively.
Figure 2:
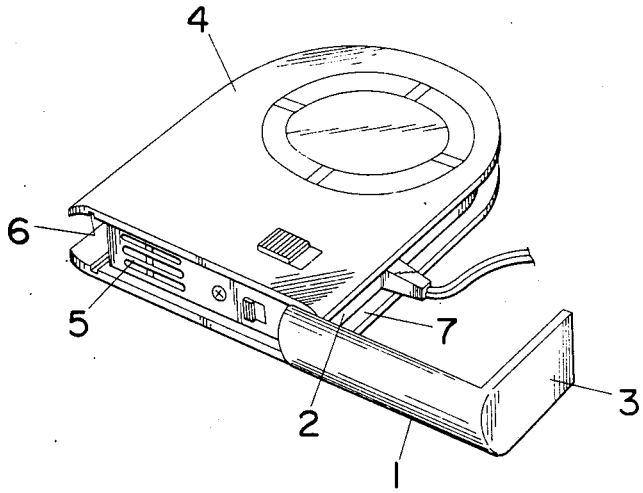
Fig. 2 (PRIOR ART)
Figure 3:
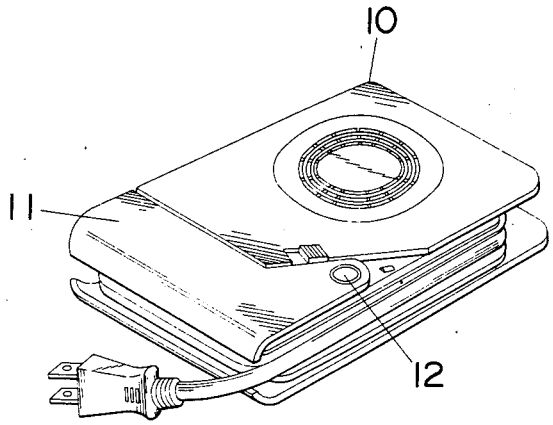
Fig. 3 (PRIOR ART)
FIG. 3 is a perspective view, in schematic representation, of another prior portable hair dryer with a hand grip being in a folded position.
Figure 4:
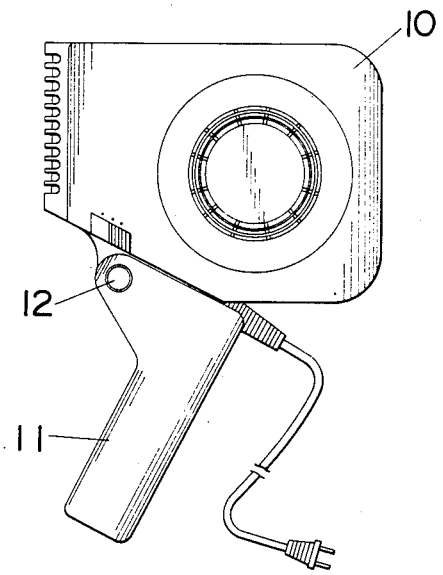
Fig. 4 (PRIOR ART)
FIG. 4 is a front view of the hair dryer of FIG. 3 with its hand grip being in an extended position.
Figure 5:
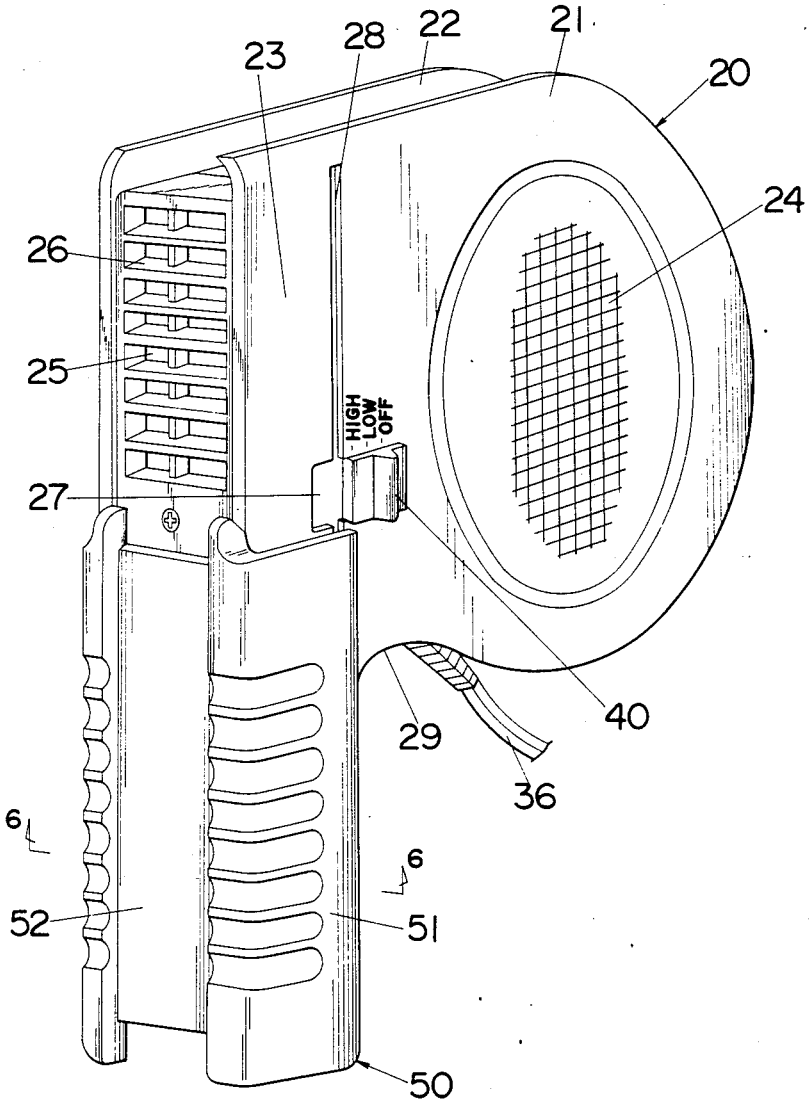
FIG. 5 is a perspective view of a portable hand-held hair dryer in accordance with a first embodiment of the present invention.

Referring now to FIG. 5, there is shown a portable hand-held hair dryer in accordance with a first embodiment of the present invention. The hair dryer is shaped into a low profile configuration and comprises a flat housing 20 and a hand grip 50 slidably connected thereto. The housing 20 is composed of a pair of side halves 21 and 22 of plastic material and is shaped to have a vertically elongate front edge portion 23. Formed in the opposite side walls 21 and 22 of the housing 20 at portions rearwardly of said front edge portion 23 are a pair of grilled circular openings or air inlets 24. An air outlet 25 is formed between the front ends of the side walls 21 and 22 to extend along said front edge portion 23 and is provided with a grid 26.

Figure 6:
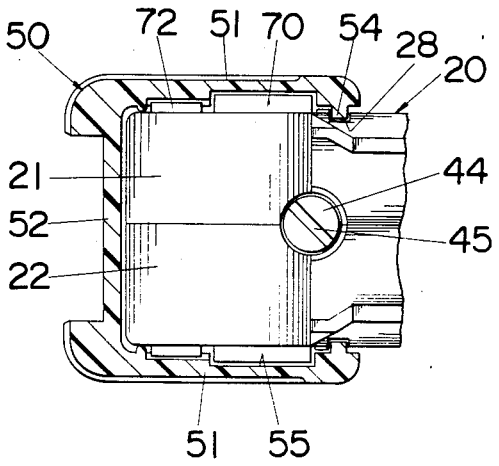
FIG. 6 is a cross section taken along line 6—6 of FIG. 5.
Figure 7:
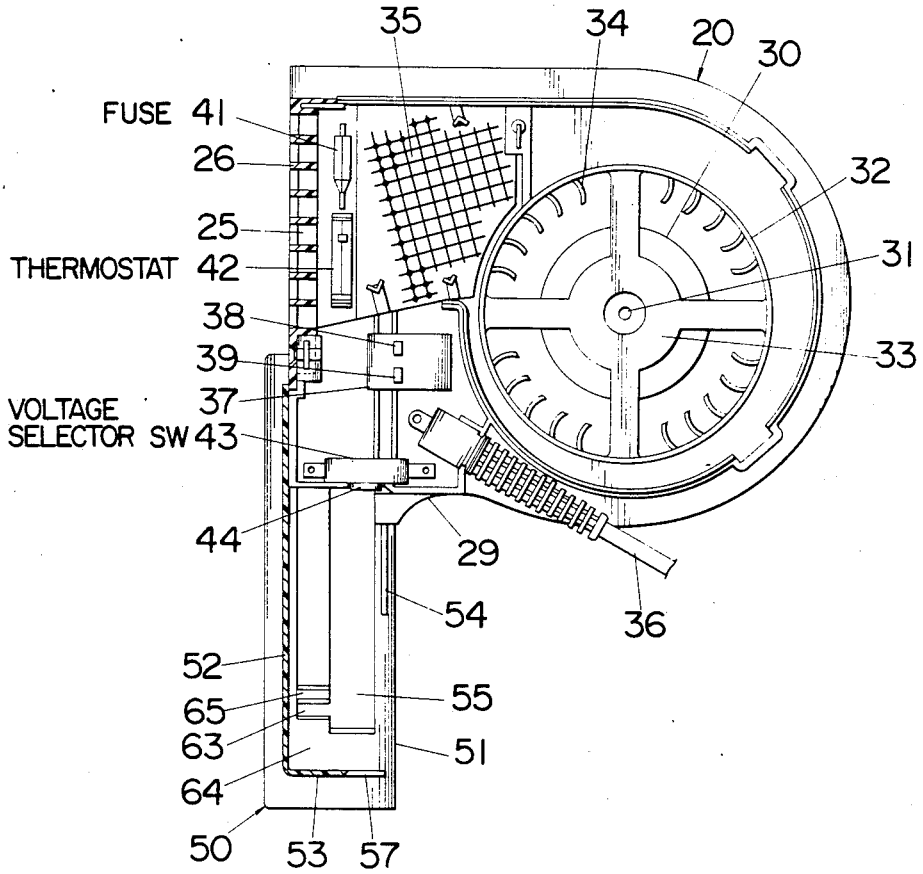
FIG. 7 is a vertical sectional view of the above hair dryer.
Figure 8:
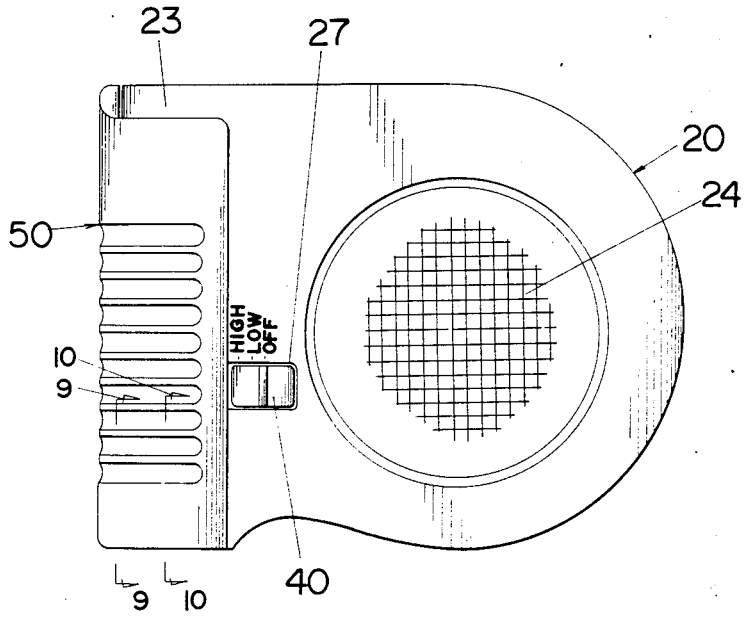
FIG. 8 is a front view of the above hair dryer with its hand grip in its retracted position.
Figure 16:
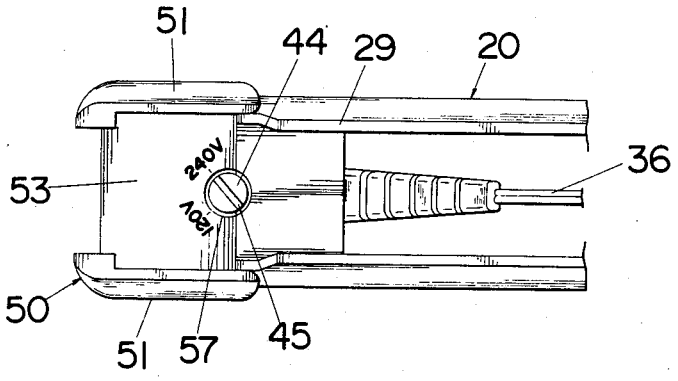
FIG. 16 is a partial bottom view of the above hair dryer with the hand grip in the retracted position.
Figure 17:
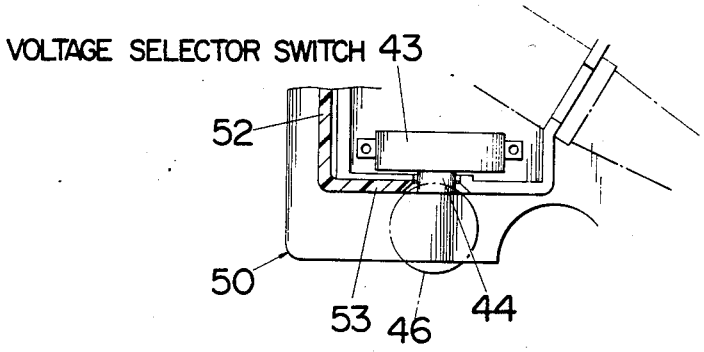
FIG. 17 is a fragmentary view of the bottom part of the above hair dryer, illustrating a manner in which a voltage selector is manipulated by the use of a coin.

As illustrated in FIG. 7, disposed within the rear portion of the housing 20 are an electric motor 30 and a circular blower fan 32 which are coaxially mounted with an output rotor shaft 31 of the motor 30 secured to a hub 33 of the blower fan 32. The circular blower fan 32 has a plurality of arcuate blades 34 which, when rotating, draw in air through the air inlets 24 and discharge the air out through the air outlet 25. A resistive heater 35 is disposed within the housing 20 between the air outlet 25 and the blower fan 32 in order to heat the air flowing toward the outlet 25. The motor 30 and the heater 35 are connected in a circuit to a power cord 36 for connection with a power source and are controlled by an electric switch 37 inserted in the circuit. The hair dryer of the embodiment is operated at two different heating levels and two different fan speeds, the faster fan speed used with the high heating level and the lower fan speed with the low heating level. To this end, a single switch handle 40, as shown in FIG. 8, having "high", "low", and "off" positions is operatively connected to the electric switch 37 so as to selectively engage actuators 38 and 39 of the switch 37 for actuation thereof. The switch handle 40 is slidably held on the housing 20 to be movable between the above positions. Within the housing 20 and rearwardly of the air outlet 25 there are disposed a combination fuse 41 and thermoswitch 42 for preventing the temperature of the heated air from exceeding a desired temperature level. A voltage selector 43 is also included in the circuit for selection between a high voltage source (for example, 240 V) and a low voltage source (120 V) on which the hair dryer operates. The voltage selector 43 is disposed within the housing 20 at the lower end of said front edge portion 23 with its operating knob 44 exposed on the bottom wall of the housing 20, as best shown in FIGS. 6 and 16, said operating knob 44 is made so that its exposed surface has a slot 45 for receiving a coin 46 or the like so that the voltage selector 43 can be manipulated from the exterior of the housing 20, as schematically shown in FIG. 17.

As illustrated in FIG. 6, said hand grip 50 is made of a plastic material to be generally U-shaped in cross section with a pair of limbs 51 extending on opposite sides of a base 52, the outer surface of the limbs 51 being knurled to facilitate gripping. The hand grip 50 has at its lower end an integral end plate 53 extending from the lower end of the base 52 between the limbs 51. Each of the limbs 51 has inward projections 54 which extend lengthwise along the inner walls of the grip. These projections fit slidably into corresponding grooves 28 in the sides of the housing 20. Those grooves extend almost the entire length of said front edge of said housing 20 such that the hand grip 50 can slide along the length of the front edge portion 23 for movement in a straight path between two extreme positions, one being a projected position in which the hand grip 50 slides along and out from the front edge portion 23 of the housing 20 to be ready for use (as best shown in FIGS. 5 and 7), and the other being a retracted position in which the hand grip 50 overlies the front edge portion 23 (as shown in FIG. 8). At the latter position, the hand grip 50 has its entire length received within the length of the front edge portion 23. This puts the grip's base 52 in position to block the air outlet 25, thus preventing entry of foreign matter into the housing 20 while the hair dryer is not in operation.

Figure 12:
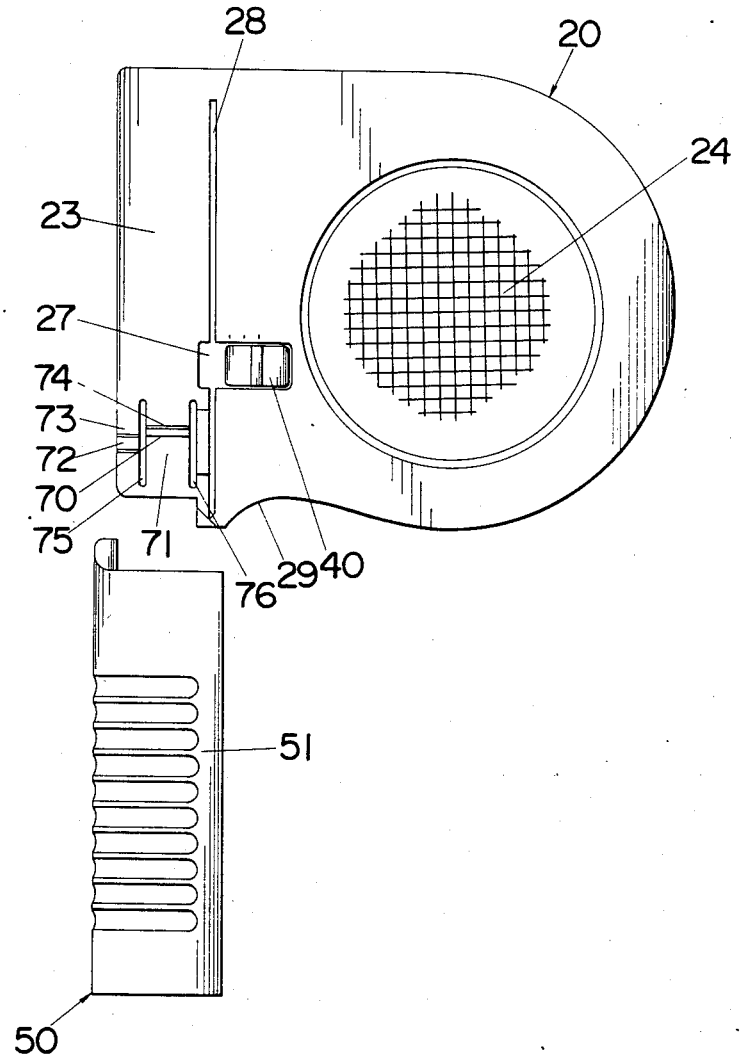
FIG. 12 is an exploded view of the above hair dryer.

As illustrated in FIG. 12, formed on the lower end of the front edge portion 23 on either side of the housing 20 are a combination stopper projection 70 and detent projection 72 which are introduced for preventing the hand grip 50 from slipping away from the housing 20 and at the same time for assuring detenting movement of the hand grip 50 between the projected and retracted positions. The stopper projection 70 is formed on a resilient segment 71 bordered by a pair of parallel slits 75 and 76 in either of the side walls 21 and 22 of the housing 20 so that the stopper projection 70 is allowed to resiliently flex outwardly and inwardly together with the resilient segment 71. The detent projection 72 is formed on another resilient segment 73 defined between the projection itself, the forward edge of each side wall and the adjacent slit 75 so that it is likewise allowed to flex outwardly and inwardly together with the resilient segment 73.

Figure 9:
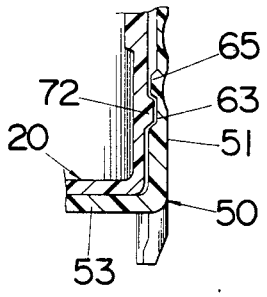
FIG. 9 is a cross section taken along line 9—9 of FIG. 8.
Figure 10:
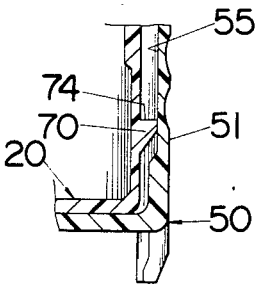
FIG. 10 is a cross section taken along line 10—10 of FIG. 8.
Figure 11:
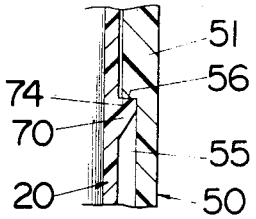
FIG. 11 is a sectional view similar to FIG. 10 but illustrating the engaging portion between a housing and the hand grip slid into its projected position.
Figure 13:
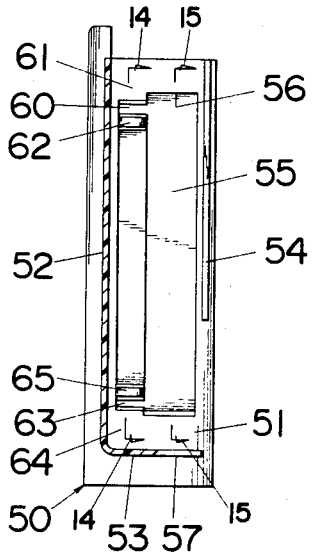
FIG. 13 is a vertical cross section of the hand grip employed.
Figure 14:
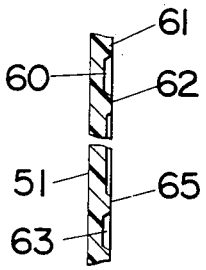
FIG. 14 is a partially broken away cross section taken along line 14—14 of FIG. 13.
Figure 15:
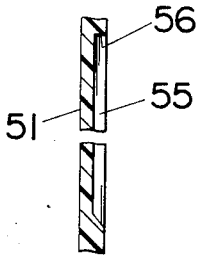
FIG. 15 is a partially broken away cross section taken along line 15—15 of FIG. 13.

As best shown in FIG. 13, the hand grip 50 is formed so that the inner surface of each limb 51 has a lengthwise depression 55 extending from a point adjacent the free end of the limb 51. The depression 55 has a step 56 in its upper end so that the stopper projection 70 is engaged when the hand grip 50 is slid into the projected position for preventing the hand grip 50 from slipping away from the housing 20, as shown in FIG. 11. Formed respectively inwardly of the upper and lower ends of the depression are indentations 60 and 63 which are defined respectively between the upper plateau 61 and the adjacent ridge 62 and between the lower plateau 64 and the adjacent ridge 65, as shown in FIG. 14. As the hand grip 50 is slid toward the projected position, the detent projections 72 cam over the upper ridges 62 by the help of said resiliency imparted to the detent projections 72, and are latched or locked in the respective upper identations 60, thereby retaining the hand grip 50 in the projected position. In the same manner, the hand grip 50 is locked or retained in the retracted position as the detent projections 72 engage into the respective lower indentations 63, as shown in FIG. 9, at which position the end plate 53 of the hand grip 50 abuts against the bottom of the housing 20, whereby the hand grip 50 is prevented from further sliding upwardly past the retracted position. It is noted that said stopper projections 70 and the detent projections 72 have their lower ends beveled or rounded so that these projections can be readily flexed inwardly at the time of being engaged with the upper edge of the limbs 51 of the hand grip 50, permitting an easy assembly of the hand grip 50 onto the housing 20. Once the hand grip 50 is connected to the housing 20, it is prevented from being detached from the housing 20 since an upright shoulder 74 of each stopper projection 70 will be in locking engagement with the step 56 at the upper end of the depression 55 in each limb 51, as shown in FIG. 11.

The housing 20 has a contoured edge behind and adjacent to the hand grip 50 so that when the grip is in its projected position, the continuously curved contour receives a part of the user's hand as he or she grasps the hand grip 50. This provides for a balanced and comfortable support of the hair dryer at a minimum length by the hand grip.

Figure 18:
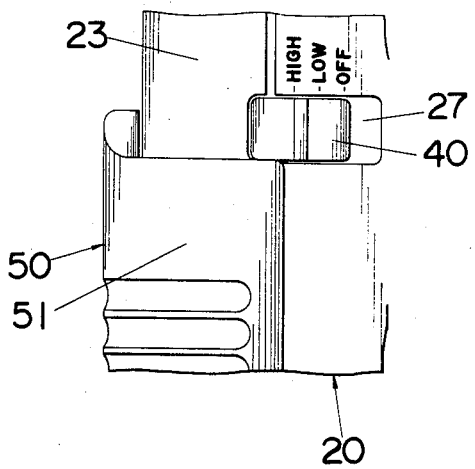
FIG. 18 is a partial view of the above hair dryer illustrating a switch handle and the upper portion of the hand grip.

The switch handle 40 is slidably received within a horizontal gutter 27 formed in one of the side walls of the housing 20 with its major portion located rearwardly of the front edge portion 23 and with its front end extending past said groove 28 into the front edge portion 23 or into the sliding path of the hand grip 50. As previously described, the switch handle 40 is a three-position selector knob which is movable between the "high", "low", and "off" positions for operation of the hair dryer at two different heating levels and two different fan speeds. The switch handle 40 is arranged to have its leading edge spaced rearwardly of the sliding path of the hand grip 50 when it is in the "off" position, as shown in FIG. 8, and to have its leading edge projected into that sliding path when it is moved into either of the "high" or "low" positions. With this result, the switch handle 40 is allowed to be moved into the "high" or "low" positions only after the hand grip 50 is moved into its projected position. In other words, the hair dryer cannot be energized so long as the hand grip 50 is in the retracted position. Likewise the hand grip 50 can only be moved into the retracted position after the switch handle 40 is moved from the "high" or "low" positions to the "off" position. Otherwise, the front end of the switch handle 40 extending into the sliding path of the hand grip 50 would come into engagement therewith, as shown in FIG. 18, thus preventing the hand grip 50 from moving into the retracted position from the projected position. This is a safe guard against accidental blocking of the air outlet 25 by the hand grip 50 while the hair dryer is operating.

The end plate 53 of the hand grip 50 has a notch 57 which receives and said voltage selector 43 located on the bottom of the housing 20. When when the hand grip 50 is moved into its retracted position, as shown in FIG. 16, the voltage selector 43 can be manipulated by the use of a coin 46 or the like as in the manner shown in FIG. 17 to select between the high and low voltage sources, for example, 240 V and 120 V on which the hair dryer is operated. For visual confirmation, indicias for such voltage values are imprinted at suitable angular positions around the notch 57. When the hand grip 50 is slid into the projected position, access to the voltage selector 43 is virtually impossible since the hand grip 50 when projected will block the fingers of the user from reaching the voltage selector 43. Accordingly, the voltage selector 43 is arranged to be accessible only when the hand grip 55 is moved into the retracted position. This is operatively combined with the above arrangement of preventing the switch handle 40 from moving into the "high" or "low" positions when the hand grip 50 is in its retracted position so as to provide an added feature that the manipulation of the voltage selector 43 can be made only when the switch handle 40 is moved into the "off" position. Thus, the voltage selector 43 can be manipulated only when the hair dryer is turned off, thus for insuring safe switching operation of the voltage selector 43.

Figure 19:
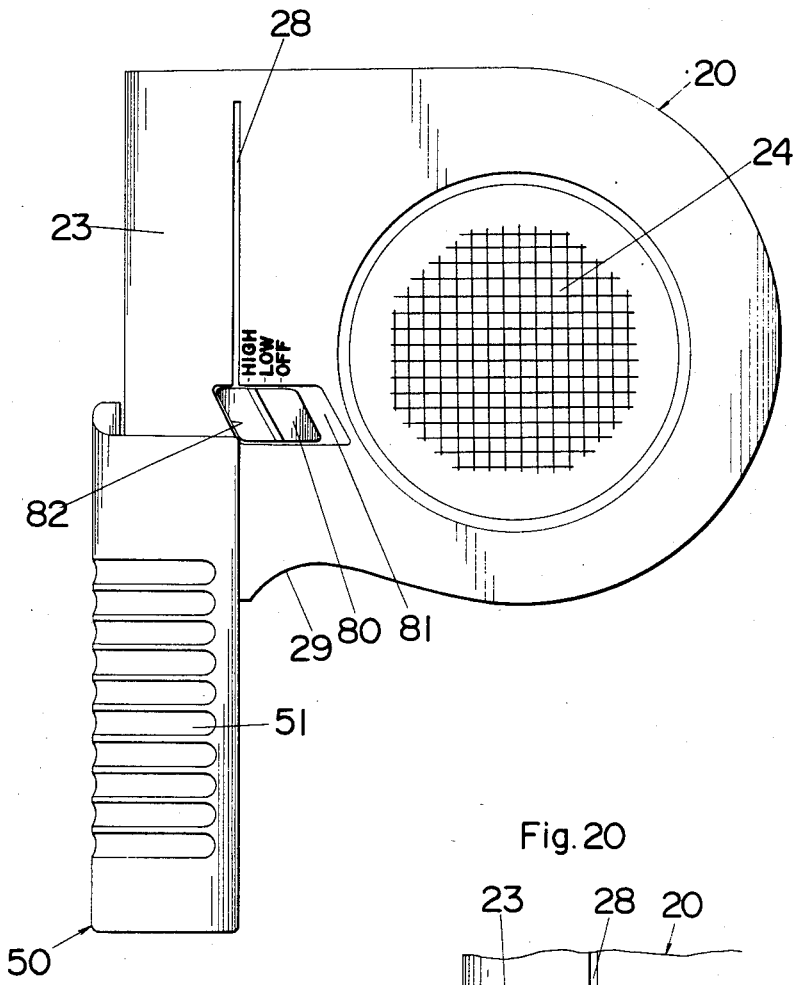
FIG. 19 is a front view of a hair dryer in accordance with a modification of the above embodiment.
Figure 20:
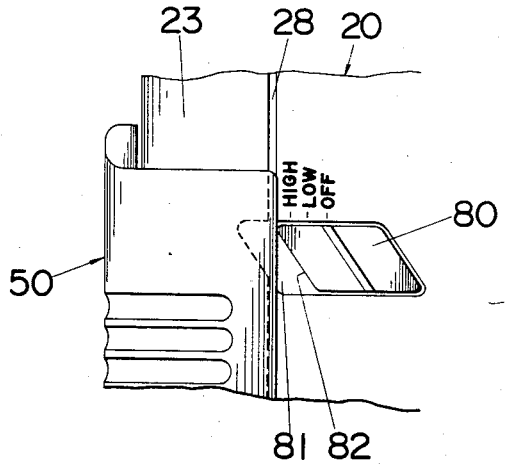
FIG. 20 is a partial view of the above dryer of FIG. 19, illustrating a switch handle and the upper portion of the hand grip.
Figure 21:
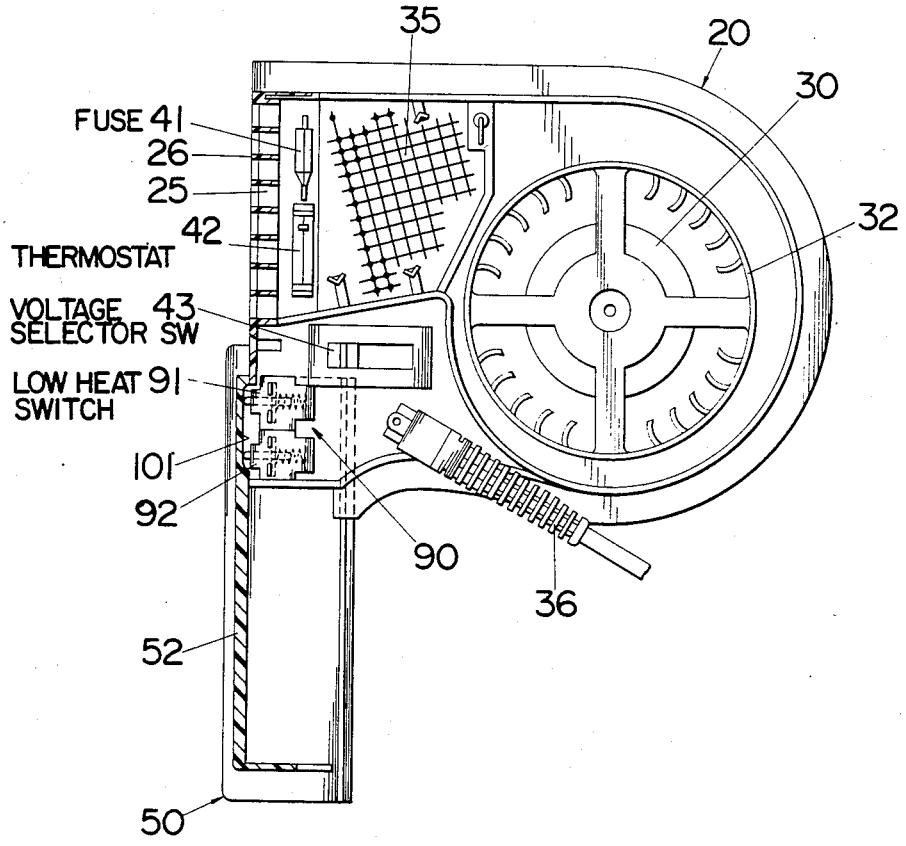
FIG. 21 is a vertical sectional view of a hair dryer in accordance with a second embodiment of the present invention.
Figure 22:
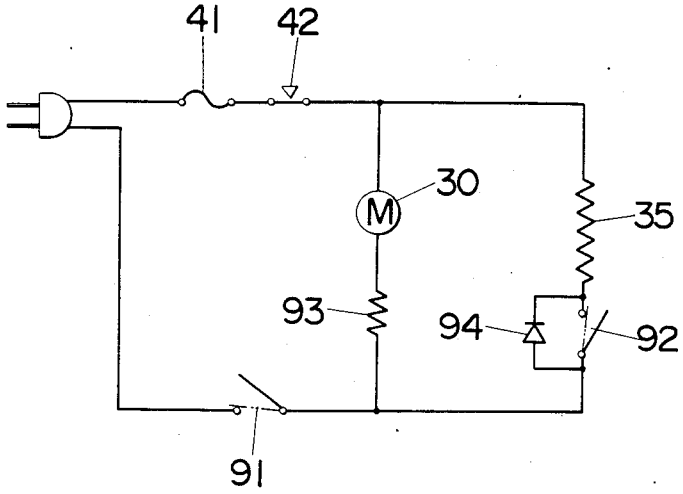
FIG. 22 is a circuit diagram of an electric circuit employed in the above hair dryer of FIG. 21.

Referring to FIGS. 19 and 20, a modification of the above embodiment is disclosed which is identical in construction to the above embodiment except for the configuration of a switch handle 80 operatively connected to the electric switch 37 inside the housing 20. The switch handle 80 of this modification is also slidably held within a gutter 81 to be movable in a direction perpendicular to the sliding direction of the hand grip 50 and is contoured to have an inclined leading edge 82 which is movable into and away from the sliding path of the hand grip 50 as the switch handle 80 is moved between the "high" or "low" positions and "off" position. The inclined leading edge 82 is engageable with the rearward edge of the hand grip 50 such that the switch handle 80 left in the "high" or "low" positions is forced by the hand grip 50 moving from the projected position to the retracted position to be slid back into the "off" position, as shown in FIG. 20, thus shutting off the hair dryer automatically. It is needless to say that the inclined leading edge 82 of the switch handle 80 will abut against the hand grip 50 being in the retracted position to be thereby prevented from moving into "high" or "low" positions of energizing the hair dryer. Consequently, the hair dryer is allowed to be set into operation only when the hand grip 50 is slid into the projected position and is automatically shut off when the hand grip 50 is slid back to the retracted position.

Referring to FIGS. 21 to 24, there is disclosed a hair dryer in accordance with a second embodiment of the present invention which is similar to the first embodiment except for a switch assembly 90 for connecting the motor 30 and the heater 35 with the power source and disconnecting them therefrom. The switch assembly 90 is composed of a pair of electric switches 91 and 92 inserted in a circuit of FIG. 22, wherein the first switch 91 is connected in series with a series combination of the motor 30 and a dropping resistor 93 as well as connected in series with another series combination of the heater 35 and the second switch 92, these series combinations being in parallel relation with one another. A bypass diode 92 is connected across the second switch 92 so as to produce less amount of heat in the heater 35 when the second switch 92 is turned off than the case when the second switch 92 is turned on, providing two different heating levels, i.e., "high" and "low" levels. The fuse 41 and thermoswitch 42 are inserted in the circuit. It is to be noted at this time that the above circuit arrangement is available for the operation of the hair dryer at a single fan speed and two different heating levels, in contrast to the previous embodiment where the hair dryer operates at two different fan speeds and two different heating levels.

Figure 23:
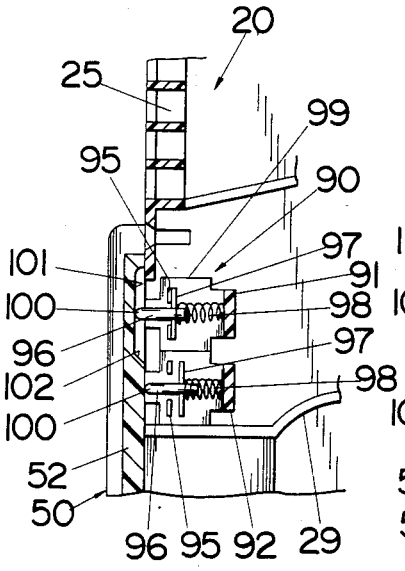
FIG. 23 is a sectional view of the above hair dryer, illustrating a pair of electric switches to be actuated by the hand grip with one of the switches being in closed condition.
Figure 24:
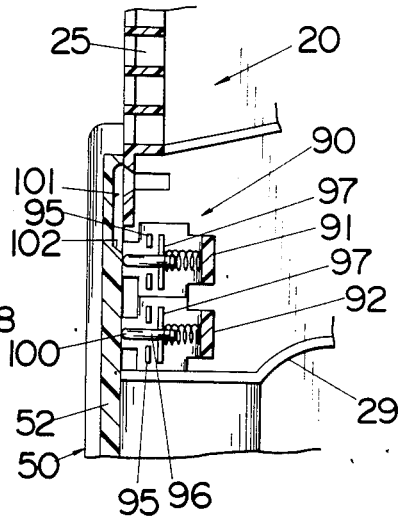
FIG. 24 is a sectional view of the above hair dryer, illustrating a pair of electric switches to be actuated by the hand grip with both switches being in open condition.

As shown in FIGS. 23 and 24, each of the first and second switches 91 and 92 comprise a pair of fixed contacts 95, a plunger 96 carrying thereon a movable contact 97 engageable with the fixed contacts 95 for bridging the fixed contacts 95, and a compression spring 98 biasing the plunger 96 in a direction of engaging the movable contact 97 with the fixed contacts 95. The front end of each plunger 96 projects from a switch casing 99 to define thereat an actuator end 100. These switches 91 and 92 are vertically arranged within the housing 20 at a portion below the air outlet 25 with each of the actuator ends 100 exposed on the front surface of the housing 20 so as to be engageable with the base 52 of the hand grip 50. Normally, the actuator end 100 of the plunger 96 of each switch 90, 91 abuts against the inner surface of the base 52 of the hand grip 50 to be thereby prevented from projecting from the casing 99 and is therefore retained against the bias of the compression spring 98 in a position which disengages the movable contact 97 from the fixed contacts 95, thus the hair dryer. The base 52 of the hand grip 50 is formed in its inner surface at the upper end thereof with a vertically elongate slot 101 into which the actuator end 100 of each plunger 96 can extend for closing the contacts. When the hand grip 50 is slid from the retracted position to a "low" position of FIG. 23, the plunger 96 of the first or upper switch 91, which is connected in series relation both with the motor 30 and the heater 35, is permitted to project into the slot 101 for closing the contacts to initiate blowing the heated air of low heating level. When the hand grip 50 is further slid from the "low" position to a "high" position or fully projected position, the actuator end 100 of the plunger 96 of the second or lower switch 92, which is in parallel connection with the bypass diode 94 and in series connection with the heater 35, is permitted to project into the slot 101 for closing the corresponding contacts to produce double the amount of heat maintained by the first switch 91 which still has its plunger 96 projecting into the slot 101. As the hand grip 50 is slid from the projected position back to the retracted position of FIG. 24, the plungers 96 of the respective switches 91 and 92 are forced by an inclined cam surface 102 at the lower end of the slot 101 to move back to open-contact conditions, thus shutting off the motor 30 and heater 35 of the hair dryer. With this arrangement, the hair dryer of the present embodiment can be automatically turned on and off simply by sliding the hand grip 50 into and away from the projected position, thus eliminating the necessity of providing an additional switch handle and therefore contributing to an increased handling performance. In this embodiment, the voltage selector 43 is disposed within the housing 20 at a portion to be accessible from the exterior thereof.

What is claimed is:

1. A portable hair dryer comprising:

a housing with an air outlet and an elongate front edge portion, said air outlet extending in a generally transverse direction of the front edge portion;

electrically energizable means disposed within the housing for producing and discharging a flow of heated air through the air outlet;

a hand grip slidable connected to the front edge portion so as to be longitudinally movable therealong in a straight path between a projected position in which the hand grip projects outwardly of the housing from one longitudinal end of said front edge portion and a retracted position in which the hand grip overlies the front edge portion substantially to close the air outlet;

stopper means formed on the front edge portion cooperating with means on the hand grip to prevent the hand grip from becoming disconnected from the housing; and a recess formed in the housing at a portion adjacent to the juncture between the projected hand grip and the housing and adapted in use for receiving a portion of the user's hand grasping the hand grip;

a manually operable voltage selector for selection between a high voltage source and a low voltage source to which the hair dryer is adapted to be electrically connected for energization thereof, said voltage selector being mounted on the longitudinal end of the front edge portion from which end said hand grip projects, said voltage selector being arranged such that it is accessible only when the hand grip is in its retracted position.

2. A portable hair dryer as set forth in claim 1, wherein said front edge portion is provided with detent means by which the hand grip is releasably locked into either of its projected or retracted positions.

3. A portable hair dryer as set forth in claim 1, in which said housing has a switch handle operatively connected to an electric switch for controlling the energization of the hair dryer, and said switch handle being slidably held on the housing for movement in a direction generally perpendicular to the sliding direction of said hand grip between on- and off-positions, said switch handle having a front end which is movable into and out of the sliding path of the hand grip, said hand grip being designed such that the front end of the switch handle abuts against the hand grip when the hand grip is in its retracted position to thereby block the switch handle from moving into the on-position but permits the switch handle to move into that sliding path without being blocked by the hand grip when the hand grip is in the projected position so that the switch handle is allowed to move into the on-position only when the hand grip is slid into its projected position.

4. A portable hair dryer as set forth in claim 1, wherein said hand grip is of U-shaped cross section with a pair of limbs on opposite sides of a base, each of the limbs being formed at its free end with an inward projection which fits slidably into a complementary guide groove formed in the side surface of the housing whereby the hand grip is guided in a straight path between its retracted position and projected position.

5. A portable hair dryer as set forth in claim 1, wherein said hand grip is operatively connected to an electrical switch in said housing for controlling the electric energization of the hair dryer in such a way that the sliding movement of the hand grip is translated into the switching operation of the switch to deenergize the hair dryer upon movement of the hand grip from its projected position to its retracted position.

6. A portable hair dryer as set forth in claim 1, wherein said housing is provided with a switch handle operatively connected to an electric switch for controlling the electric energization of the hair dryer, and said switch handle being slidably held on the housing for movement in a direction generally perpendicular to the sliding direction of said hand grip between on- and off-positions, said switch handle having an inclined leading edge which is movable into and out of the sliding path of the hand grip and is engageable with the hand grip such that when the hand grip is in its retracted position the inclined leading edge abuts against the hand grip to be thereby interrupted from moving into the sliding path thereof whereby preventing the switch handle from moving into the on-position, that when the hand grip is in its projected position the inclined leading edge is free to move into the sliding path of the hand grip so as to allow the switch handle to move into its on-position, and that the hand grip during its movement from the projected position to the retracted position engages the inclined edge of the switch handle being in the on-position to urge it from the on-position to the off-position.

7. The hair dryer of claim 1 in which the hand grip is of generally "U" shaped in cross section.

8. The hair dryer of claim 7 in which said voltage selector is positioned so as to be within the "U" of the hand grip when the hand grip is in its projected position.

* * * * *